US005315968A

United States Patent [19]

Niebrzydoski

[11] Patent Number: 5,315,968

[45] Date of Patent: May 31, 1994

[54] TWO-STAGE FUEL DELIVERY SYSTEM FOR AN INTERNAL COMBUSTION ENGINE

[75] Inventor: John L. Niebrzydoski, Cass City, Mich.

[73] Assignee: Orbital Walbro Corporation, Cass City, Mich.

[21] Appl. No.: 38,828

[22] Filed: Mar. 29, 1993

[51] Int. Cl.[5] ..... F02B 33/04; F04B 1/04

[52] U.S. Cl. ..... 123/73 C; 123/510; 417/413 R; 417/420

[58] Field of Search ..... 123/73 C, 495, 510; 417/413 R, 420, 244

[56] References Cited

U.S. PATENT DOCUMENTS

| | | | |
|---|---|---|---|
| 2,534,520 | 12/1950 | Katcher | 417/420 |
| 3,800,754 | 4/1974 | Carlson | 123/73 CB |
| 3,913,551 | 10/1975 | Shaver | 123/73 AD |
| 3,954,352 | 5/1976 | Sakai | 417/244 |
| 3,992,132 | 11/1976 | Putt | 417/420 |
| 4,700,668 | 10/1987 | Schierling | 123/73 C |
| 5,197,417 | 3/1993 | Tuckerman | 123/73 C |

FOREIGN PATENT DOCUMENTS

| | | | |
|---|---|---|---|
| 553673 | 6/1932 | Fed. Rep. of Germany | 417/413 |
| 3347538 | 7/1985 | Fed. Rep. of Germany | 417/413 |
| 0108912 | 8/1979 | Japan | 417/413 |
| 0218673 | 9/1987 | Japan | 417/413 |

*Primary Examiner*—Carl S. Miller

*Attorney, Agent, or Firm*—Barnes, Kisselle, Raisch, Choate, Whittemore & Hulbert

[57] ABSTRACT

A two-stage fuel delivery system for an internal combustion engine that includes a first stage pump having a first pump chamber with an inlet coupled to a fuel source, an outlet and a diaphragm responsive to pressure pulsations from the engine crankcase for reciprocation within the chamber. A second stage pump includes a second pump chamber having an inlet coupled to the outlet of the first chamber, an outlet for delivering fuel under pressure to engine fuel injectors or the like, a permanent magnet for mounting on the flywheel of the engine for rotation in synchronism with operation of the engine, and a diaphragm in the second chamber operatively coupled to the magnet for reciprocation with the second chamber responsive to rotation of the magnet to pump fuel from the inlet to the outlet of the second chamber. The two-stage pump achieves fuel delivery pressures on the order of 25 to 30 psi or more employing energy from reciprocation of the engine and without requiring control electronics or electrical energy input.

2 Claims, 1 Drawing Sheet

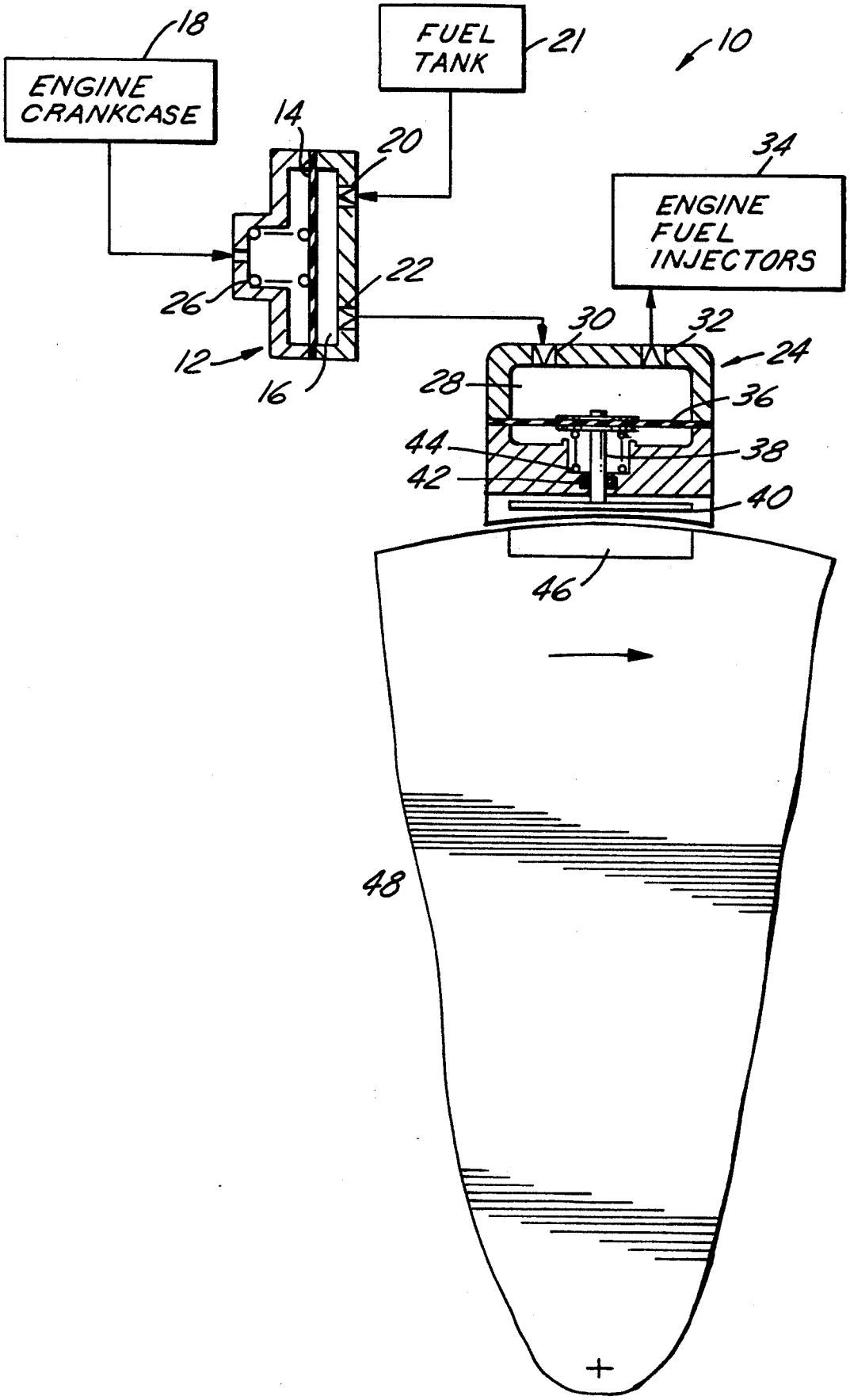
18
ENGINE CRANKCASE
FUEL TANK
21
10
14
20
34
ENGINE FUEL INJECTORS
22
26
30
32
24
12
16
28
36
44
38
42
40
46
48

TWO-STAGE FUEL DELIVERY SYSTEM FOR AN INTERNAL COMBUSTION ENGINE

The present invention is directed to fuel delivery systems for internal combustion engines, and more particularly to a two-stage fuel pump system for increasing fuel delivery pressure.

BACKGROUND AND SUMMARY OF THE INVENTION

In fuel delivery systems for internal combustion engines, particularly two-stroke engines, it has heretofore been proposed to provide a diaphragm pump responsive to pressure pulsations from the engine crankcase for feeding fuel from a supply or tank to engine fuel injectors or the like. Fuel pressures obtainable with systems of this type are typically on the order of 10 to 11 psi. A general object of the present invention is to provide a fuel delivery system that is adapted to achieve fuel delivery pressures on the order of 25 to 30 psi or more, that obtains pumping energy from reciprocation of the engine without electronic control circuitry or energy input, that is economical to manufacture, and that provides reliable operation over an extended lifetime.

A fuel pump in accordance with one aspect of the present invention comprises a chamber having an inlet for coupling to a fuel source and an outlet for delivering fuel under pressure to engine fuel injectors or the like. A pump mechanism is disposed in the chamber and coupled to first magnetic material for reciprocating the mechanism within the chamber, and thereby pumping fuel from the inlet to the outlet. Second magnetic material is mounted for motion adjacent to the first magnetic material in synchronism with operation of the engine, such that magnetic forces imparted in the first magnetic material as the second magnetic material moves therepast reciprocates the pump mechanism within the chamber. In the preferred embodiment of the invention, the pump mechanism comprises a diaphragm that spans the pumping chamber, and the first magnetic material comprises a piston coupled to the diaphragm by a rod. The second magnetic material comprises a permanent magnet mounted on the periphery of the flywheel of the engine for rotation past the magnetic piston to reciprocate the diaphragm within the chamber.

In accordance with another aspect of the present invention, a two-stage fuel delivery system for an internal combustion engine includes a first stage pump having a first pump chamber with an inlet coupled to a fuel source, an outlet and a diaphragm responsive to pressure pulsations from the engine crankcase for reciprocation within the chamber. A second stage pump includes a second pump chamber having an inlet coupled to the outlet of the first chamber, an outlet for delivering fuel under pressure to engine fuel injectors or the like, a permanent magnet for mounting on the flywheel of the engine for rotation in synchronism with operation of the engine, and a diaphragm in the second chamber operatively coupled to the magnet for reciprocation with the second chamber responsive to rotation of the magnet to pump fuel from the inlet to the outlet of the second chamber. The two-stage pump achieves fuel delivery pressures on the order of 25 to 30 psi or more employing energy from reciprocation of the engine and without requiring control electronics or electrical energy input.

BRIEF DESCRIPTION OF THE DRAWING

The invention, together with additional objects, features and advantages thereof, will be best understood from the following description, the appended claims and the accompanying drawing, which is a schematic diagram of a two-stage fuel delivery system in accordance with an exemplary presently preferred embodiment of the invention.

DETAILED DESCRIPTION OF PREFERRED EMBODIMENTS

The drawing illustrates a fuel delivery system 10 in accordance with one presently preferred embodiment of the invention as comprising a first stage pump 12 in which a diaphragm 14 spans a chamber 16 that is open on one side to pressure pulsations from the engine crankcase 18. On the opposing side of diaphragm 14, an inlet or suction port 20 is connected to a fuel supply or tank 21. An outlet or discharge port 22 delivers fuel to a second stage pump 24. A coil spring 26 biases diaphragm 14 in the direction of ports 20,22. Each port 20,22 includes a check valve, as schematically illustrated in the drawing, for preventing reverse flow of fuel through chamber 16.

Second stage pump 24 includes a second stage pump chamber 28 having an inlet or suction port 30 coupled to outlet 22 of first stage 12, and an outlet or discharge port 32 coupled to fuel injectors 34 or nozzle or the like for delivering combustion fuel at the engine. Once again, check valves are disposed at inlet and outlet ports 30,32 for preventing reverse flow of fuel through second stage pump 24. A diaphragm 36 spans chamber 28. On the side of diaphragm 36 remote from ports 30,32, a rod 38 is coupled to a piston 40 of magnetic material. Piston 40 in the drawing takes the form of a flat disk coaxial with rod 38 and diaphragm 36. A seal 42 surrounds rod 38, and a coil spring 44 surrounds rod 38 within chamber 28 to engage diaphragm 36. A permanent magnet 46 is mounted on the periphery of the engine flywheel 48 for rotation past piston 40 in synchronism with operation of the engine—i.e., once per revolution of the engine crankshaft.

In operation, first stage pump 12 is responsive to pressure pulsations from engine crankcase 18 for drawing fuel from tank 21 and discharging fuel under pressure to second stage pump 24. Within second stage pump 24, piston 40 is responsive to magnetic forces generated by magnet 46 during motion as the magnet rotates past the piston to reciprocate diaphragm 36 within chamber 28 alternately with and against the forces imparted on diaphragm 36 by coil spring 44. This reciprocation of diaphragm 36 draws fuel through inlet port 38, and discharges fuel at increased pressure from outlet port 32 to fuel injectors 34. First or boost pump stage 12 delivers fuel at a pressure on the order of 10 to 11 psi. The outlet pressure from second stage pump 24 is on the order of 25 to 30 psi or more.

Although the invention has been described in connection with an exemplary presently preferred embodiment thereof, alternatives and modifications may be implemented without altering or departing from the principals of the invention in their broadest aspects. For example, either or both of the pump stages 12,24 may include pistons rather than diaphragms for reciprocation with the corresponding pump stage chamber. Indeed, in second stage pump 24, a single piston may be both responsive to magnetic forces from magnet 46, and operatively coupled to the chamber inlet and outlet ports for achieving the pumping action. It will also be recognized that multiple stages 24 may be provided around the periphery of flywheel 48 and responsive to magnet 46 for further increasing fuel delivery pressure. In the same way, multiple magnets 46 may be provided on flywheel 48. Pump stages 12,24 may be provided as separate units as illustrated in the drawing, or may be integrated into a single compact and inexpensive package. Further, the diaphragm and springs can be modified to deliver higher or lower pressures depending upon specific requirements.

I claim:

1. A two-stage fuel delivery system for a two-stroke internal combustion engine that comprises:

a first stage pump that includes a first pump chamber having an inlet coupled to a fuel source, an outlet, and means responsive to pressure pulsations from a crankcase of the engine for reciprocation in said chamber to pump fuel from said inlet to said outlet, and a second stage pump that includes a second pump chamber having an inlet coupled to said outlet of said first chamber, an outlet for delivering fuel under pressure, a permanent magnet for mounting on a flywheel of the engine for rotation in synchronism with operation of the engine, and means disposed in said second chamber adjacent to the engine flywheel and operatively coupled to said magnet for reciprocation in said second chamber responsive to said magnet to pump fuel from said inlet to said outlet of said second chamber.

2. The two-stage fuel delivery system set forth in claim 1 wherein said means disposed in said second chamber comprise a flexible diaphragm and magnetically permeable means mounted to said diaphragm for reciprocal actuation by said permanent magnet mounted on the flywheel.

* * * * *